United States Patent [19]

Dakin

[11] 3,950,895

[45] Apr. 20, 1976

[54] METHOD AND APPARATUS FOR GRINDING WORK PIECES

[75] Inventor: Roland Peter Dakin, Allesley, England

[73] Assignee: Olin Energy Systems Limited, Sunderland, England

[22] Filed: Mar. 21, 1975

[21] Appl. No.: 560,911

[52] U.S. Cl. ..... 51/5 B; 51/108 R; 51/215 AR; 51/281 R

[51] Int. Cl.[2] ..... B24B 5/04; B24B 1/00; B24B 47/20

[58] Field of Search ..... 51/5 B, 53, 108 R, 134, 51/145 T, 215 AR, 215 HM, 215 UE, 281 R, 290, 237 T

[56] References Cited

UNITED STATES PATENTS

| | | | |
|---|---|---|---|
| 1,898,648 | 2/1933 | Thorsen | 51/108 R |
| 1,991,712 | 2/1935 | Theler | 51/108 R |
| 2,436,561 | 2/1948 | Flygare | 51/108 R |
| 3,284,959 | 11/1966 | Seidel | 51/108 R |
| 3,665,648 | 5/1972 | Yamanaka | 51/134 |
| 3,858,369 | 1/1975 | Dolgou | 51/5 B |

*Primary Examiner*—Al Lawrence Smith
*Assistant Examiner*—Nicholas P. Godici
*Attorney, Agent, or Firm*—Donald R. Motsko; William W. Jones

[57] ABSTRACT

A method and apparatus for grinding work pieces having internal chambers comprising loading blank work pieces onto respective ones of a plurality of mandrels provided on a rotatable member which member is rotatable about an axis of rotation extending parallel to the mandrels, the mandrels being equi-spaced about the axis of rotation; rotating the blanks on the mandrels; rotating a profiled grinding wheel; effecting rotary indexing of the rotatable member such that each of the blanks thereon successively moves relatively rapidly from a position spaced from the grinding wheel toward the grinding wheel to a position immediately adjacent the grinding wheel, moves relatively slowly from the adjacent position into contact with the grinding wheel and stops at the contact position for grinding to be completed, then moves rapidly away from the grinding wheel; and ejecting the ground work piece from the mandrel. Means are also provided for forming a through-passage axially in the work pieces.

8 Claims, 8 Drawing Figures

METHOD AND APPARATUS FOR GRINDING WORK PIECES

The invention relates to a method of and apparatus for grinding workpieces.

The invention is particularly, though not exclusively, applicable to form-grinding of alumina spark plug insulators with a profiled grinding wheel. Blanks for such insulators can be formed by isostatic pressing as described in U.S. Pat. No. 3,820,934 issued June 28, 1974 to Anton Stigler.

It has been previously proposed to mount alumina spark plug insulators rotatably on respective mandrels, which mandrels are in turn mounted on a rotatable member having an axis of rotation which extends parallel to the axis of the mandrels, the mandrels being equi-spaced from the axis of rotation of the rotatable member. The blanks to form the insulators can be rotated on the mandrels and the rotatable member can be rotated about its axis of rotation to cause the blanks on the mandrels to be fed past a rotating profiled grinding wheel, thereby to cause the grinding wheel to grind away portions of the blanks to form insulators of desired shape.

Merely feeding the blanks past the grinding wheel tends, unless the rate at which they are fed past the grinding wheel is very low, to cause the blanks to have an external surface which is not truly circular and/or which is not concentric with an inner bore of the insulators which is located on the respective mandrel. It is possible to index the rotatable member such that the blanks on the mandrels are individually presented to the grinding wheel and held rotating but otherwise stationary while the grinding wheel effects the grinding operation. Such a method of grinding is, however, uneconomically slow.

According to one aspect of the invention, a method of grinding workpieces comprises loading blank workpieces onto respective ones of a plurality of mandrels provided on a rotatable member rotatable about an axis of rotation extending parallel to the mandrels, the mandrels being equi-spaced from said axis of rotation; rotating the blanks on the mandrels; rotating a profiled grinding wheel; effecting rotary indexing of the rotatable member such that each of the blanks thereon successively moves relatively rapidly from a position spaced from the grinding wheel towards the grinding wheel to a position immediately adjacent the grinding wheel, moves relatively slowly from said position immediately adjacent the grinding wheel into the path of the grinding wheel to a position of maximum intersection with the path of the grinding wheel, stops at such position of maximum intersection for a grinding operation to be completed and moves relatively rapidly away from such position of maximum intersection; and ejecting the ground workpieces from the rotary member.

According to another aspect of the invention, apparatus for grinding workpieces comprise a rotatable member mounting a plurality of mandrels; means for loading blank workpieces onto the mandrels; the rotatable member being rotatable about an axis of rotation extending parallel to the mandrels and the mandrels being equi-spaced from said axis of rotation; means for rotating the blanks on the mandrels; a profiled rotatable grinding wheel; means to cause rotary indexing of the rotatable member such that each of the blanks successively moves relatively rapidly from a position spaced from the grinding wheel towards the the grinding wheel to a position immediately adjacent the grinding wheel, moves relatively slowly from said position immediately adjacent the grinding wheel into the path of the grinding wheel to a position of maximum intersection with the path of the grinding wheel, stops at such position of maximum intersection for a grinding operation to be completed and moves relatively rapidly away from such position of maximum intersection; and means for ejecting the ground workpieces from the rotatable member.

Preferably the means for loading the blank workpieces onto the rotatable member are automatic and take blank workpieces from a loading conveyor and the means for ejecting the ground workpieces from the rotatable member are automatic and eject the ground workpieces onto a discharge conveyor.

Advantageously the means for loading, the means for ejecting, the loading conveyor and the discharge conveyor receive motive power from a single drive unit which also supplies motive power to the means to cause rotary indexing of the rotatable member, whereby they all operate in synchronism in that they all have the same overall cycle time.

The single drive unit is preferably a gearbox having an input drive shaft coupled to an electric drive motor, a first constant speed output shaft coupled by positive drive pulleys and belt to the loading conveyor and the discharge conveyor, and to driving cams having cam followers connected respectively to the loading means and the ejecting means, and the gear box also has a second variable speed output shaft coupled to the rotatable member to cause indexing thereof, the speed of rotation of the first constant speed output shaft and the average speed of rotation of the second variable speed output shaft having a fixed ratio one to the other.

When used for profile grinding of alumina isostatically pressed spark plug insulators, the apparatus of the invention preferably also includes means to remove a portion of one end of the blank such that a blind-bore in the blank, which blind-bore receives the mandrel, is converted into a through-bore, a chamfer preferably being formed around the bore at said one end of the blank at the same time. Said means to remove a portion are preferably also driven from the first constant speed output shaft of the gearbox by means of pulleys, belts and a cam and cam follower.

The position of the profiled grinding wheel with respect to the rotatable member is preferably adjustable to compensate for wear of the grinding wheel and the grinding wheel is driven by an electric motor.

The means to rotate the blanks on the mandrels preferably comprises a drive wheel, constantly rotated by an electric motor positioned within the pitch circle of the mandrels but eccentrically of the axis of rotation of the rotatable member and faced with a resilient material, for example rubber, whereby blank workpieces on the mandrels are, due to the eccentric mounting of the drive wheel with respect to the rotatable member, engaged with the rotating drive wheel as they move into said position immediately adjacent the grinding wheel and are thereby rotated on the mandrels. Preferably, the axis of the drive wheel is angled with respect to the axis of the rotatable member whereby, when engaged with the drive wheel, the blank workpieces are biased axially along the mandrels against a stop thereby locating them accurately in a desired position.

It is, therefore, an object of this invention to provide a method and apparatus for the grinding of work pieces wherein blank workpieces are mounted on respective mandrels and move along an arcuate path about an axis from a position remote from a grinding wheel into a position contacting the grinding wheel for the grinding operation, and then moved away from the grinding wheel again.

It is an additional object of this invention to provide a method and apparatus of the character described wherein the workpieces are moved relatively rapidly to a position adjacent the grinding wheel and then relatively slowly into contact with the grinding wheel and held in the contact position for a period of time sufficient to effect the grinding operation.

It is another object of this invention to provide a method and apparatus of the character described having a rotating member positioned to engage the workpiece during the grinding operation to impart rotational movement to the workpiece on the mandrel during grinding.

It is yet another object of this invention to provide a method and apparatus of the character described wherein blank workpieces are moved by conveyor means to the mandrels, automatically mounted on the mandrels, automatically withdrawn from the mandrels after grinding, and moved by conveyor means away from the apparatus.

These and other objects and advantages of the invention will become more readily apparent from the following detailed description of a preferred embodiment of the invention taken in conjunction with the accompanying drawings, in which.

Figure 2:
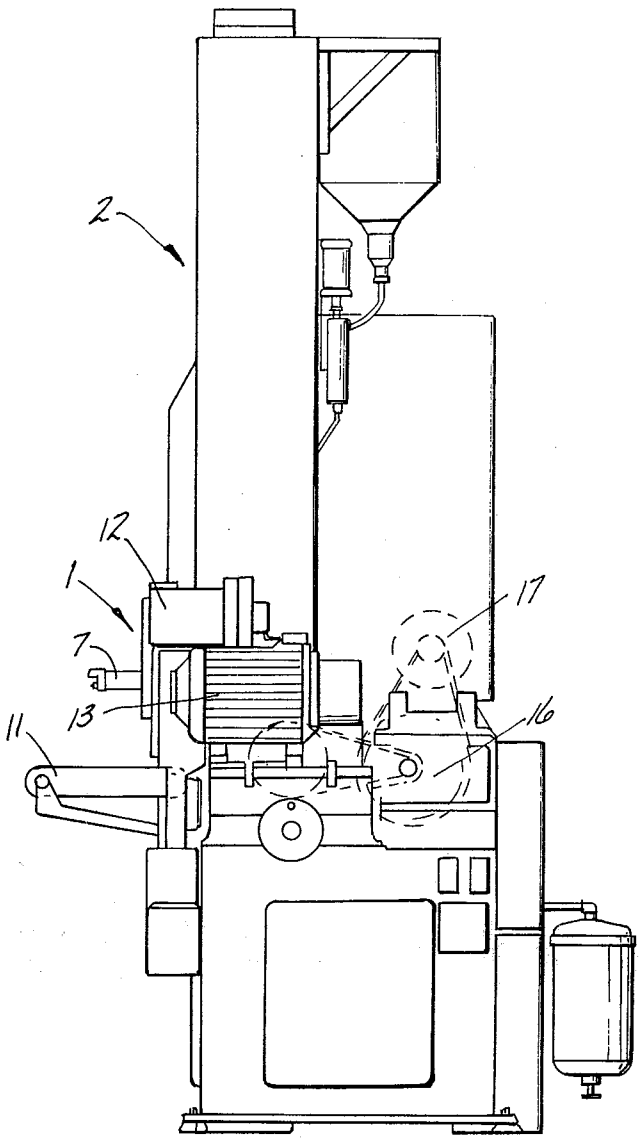
FIG. 2 is a right side elevational view of the apparatus of FIG. 1.
Figure 1:
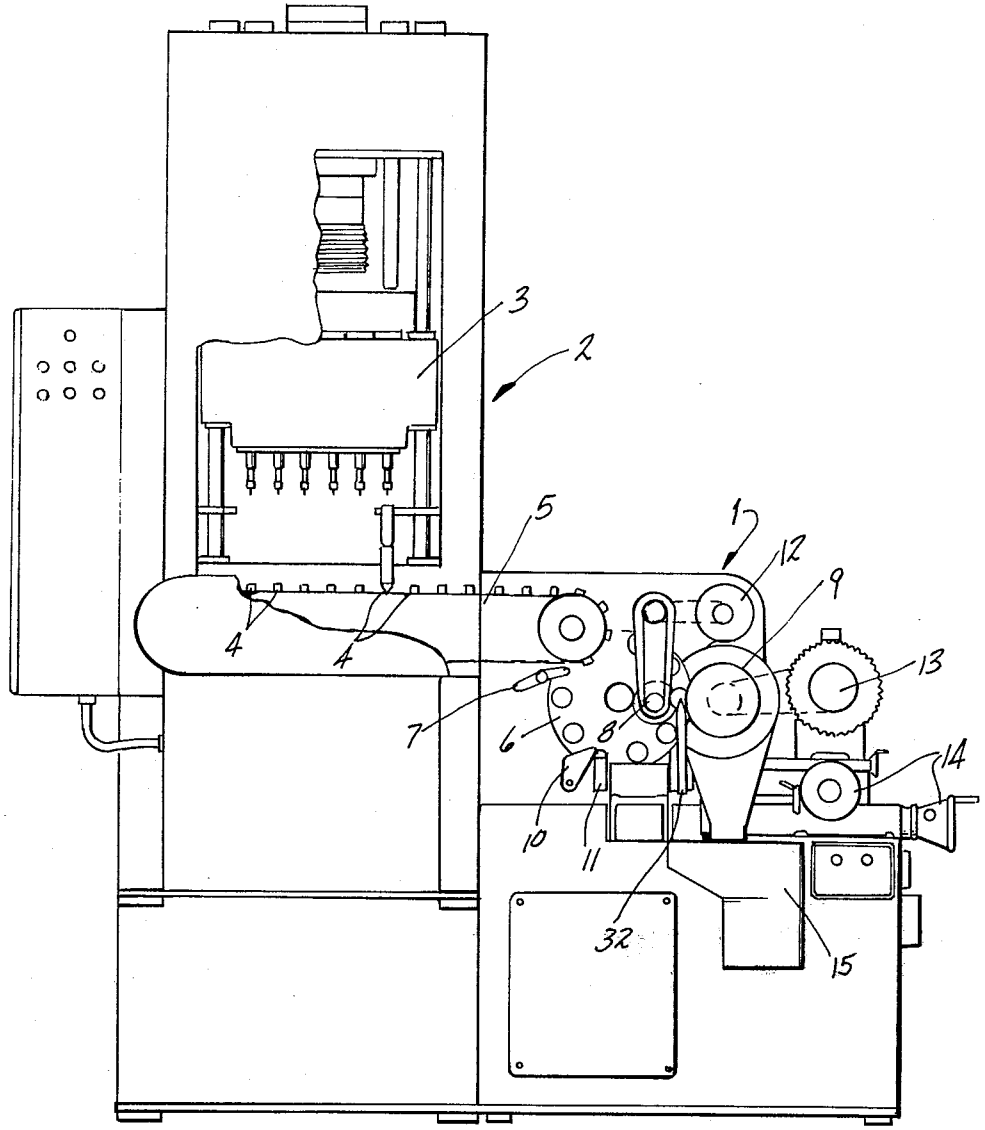
FIG. 1 is an elevational view of a preferred embodiment of an apparatus for grinding workpieces shown in conjunction with an isostatic press.

Referring to the drawings, and firstly to FIGS. 1 and 2, grinding apparatus generally indicated at 1 operates in conjunction with isostatic pressing apparatus generally indicated at 2. The isostatic pressing apparatus 2 is advantageously of the kind described in U.S. Pat. No. 3,820,934 referred to above and has a six mould head 3 which moulds six alumina spark plug insulator blanks in each moulding operation, the six blanks subsequently being delivered simultaneously to respective cups 4 of a conveyor 5 which can be of any construction and does not form a part of this invention. The conveyor 5 is progressed to the right as viewed in FIG. 1 in single cup steps by a drive gearbox via a five stop Geneva mechanism. After each six cup spacing steps forward, the moulding head 3 delivers simultaneously six blanks into the six empty cups 4 of the conveyor 5 which will by then be located thereunder.

The grinding mechanism 1 comprises a rotatably indexable head 6, a feed mechanism 7 for loading blanks from the conveyor 5 onto the indexable head 6, a drive wheel 8, a grinding wheel 9, an ejection mechanism 10 and a discharge conveyor 11 onto which ground blanks are ejected by the ejection mechanism 10.

Respective drive motors 12 and 13 are provided for the drive wheel 8 and grinding wheel 9. The grinding wheel 9 together with its drive motor 13 are provided on carriages controlled by control wheels 14 whereby the position of the grinding wheel 9 can be adjusted and a vacuum dust extraction arrangement 15 is provided to collect material ground-off by the grinding wheel 9.

A back-lash free reduction gearbox 16 is belt driven from a variable speed electric motor 17, the gearbox 16 having two output shafts which are driven with a synchronised cycle. The two output shafts include a first constant speed output shaft 30 (see FIG. 3) driving the feed conveyor 5, the loading mechanism 7, the ejection mechanism 10, the discharge conveyor 11 and a work piece tip cutting mechanism 32, described more fully hereinafter, and a second varying speed output shaft (not shown) rotating and indexing the head 6 at a varying speed.

Figure 3:
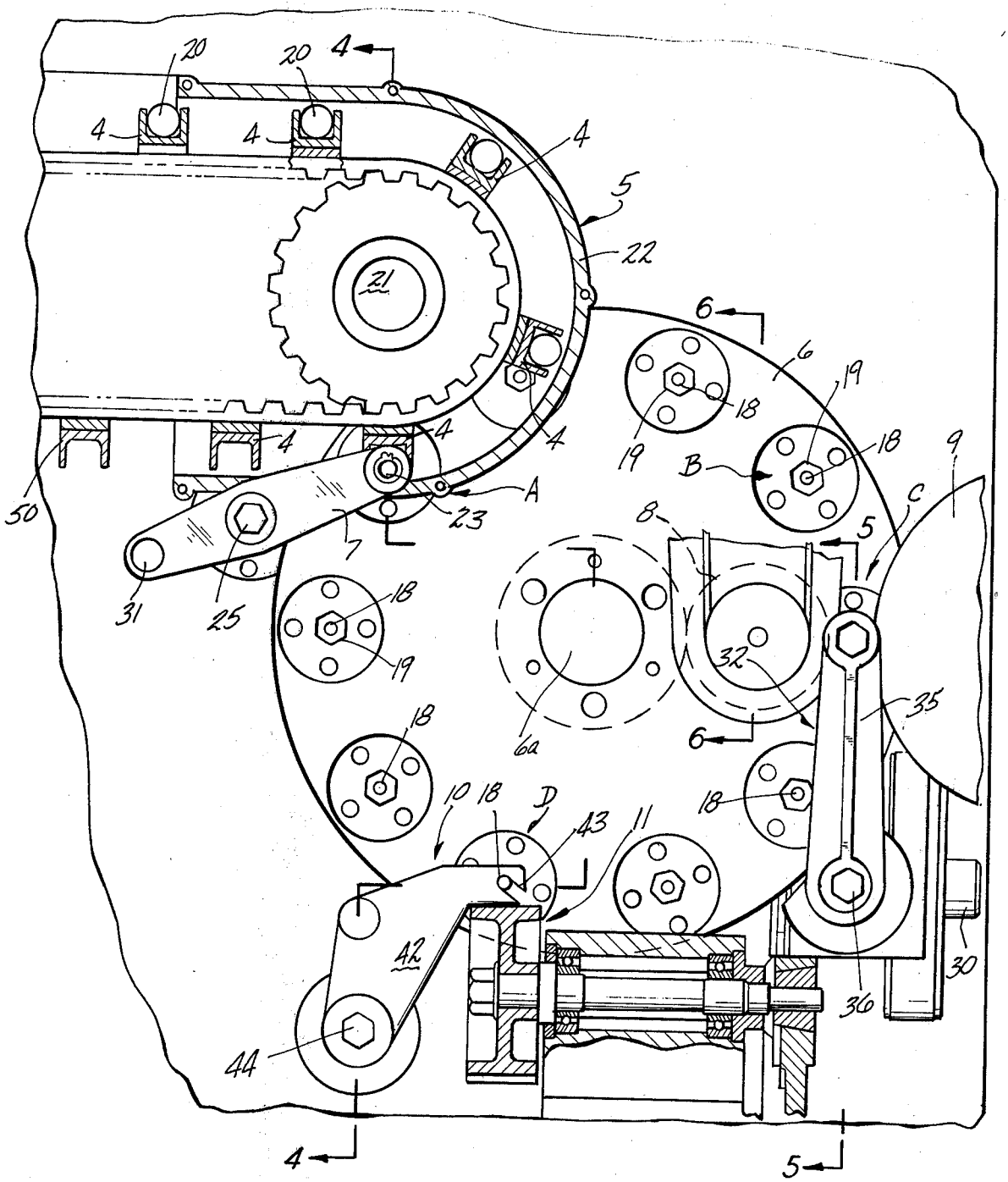
FIG. 3 is an elevational view partly in section and enlarged of a portion of FIG. 1.
Figure 4:
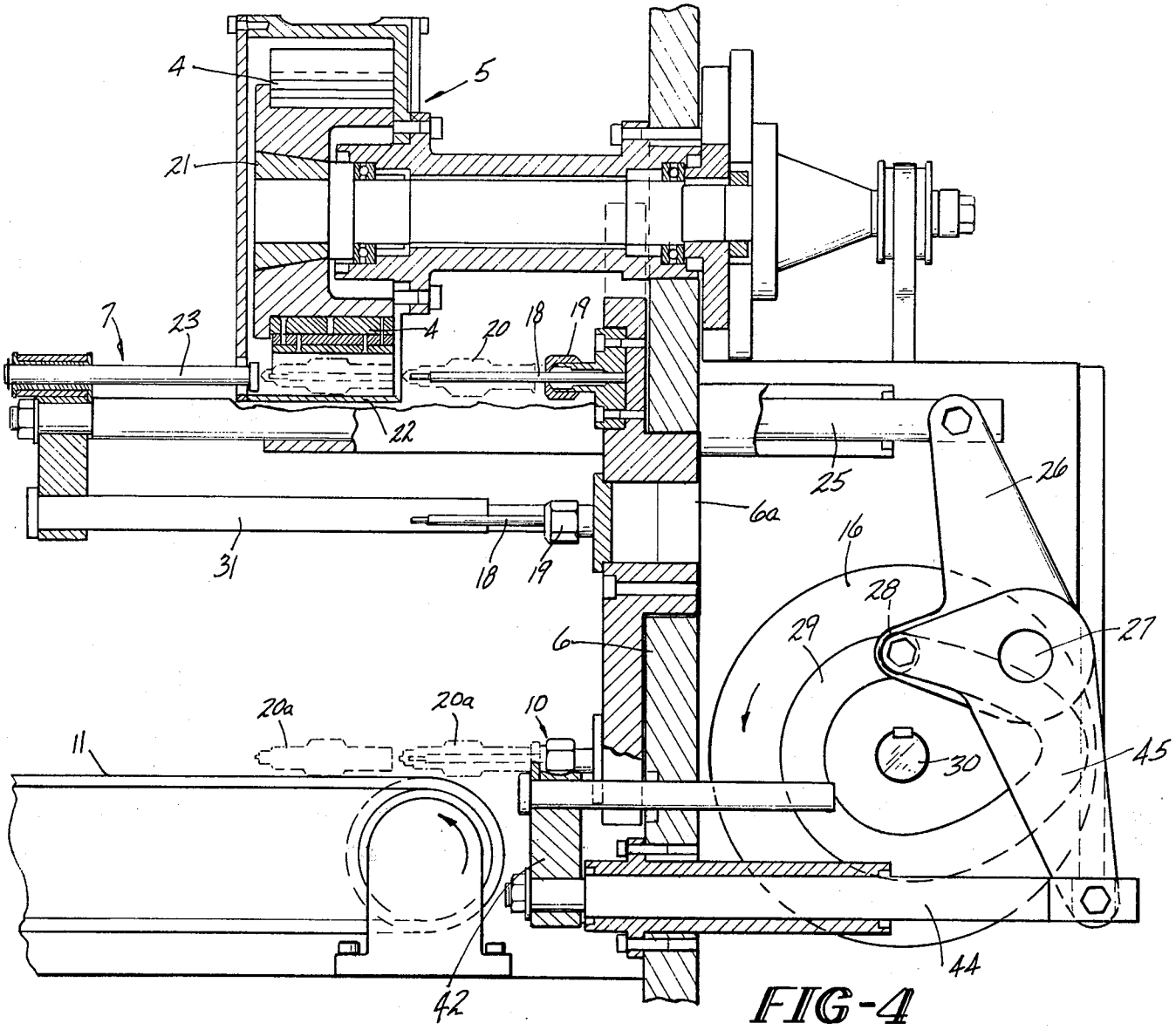
FIG. 4 is a sectional view taken on line 4—4 of FIG. 3.
Figure 5:
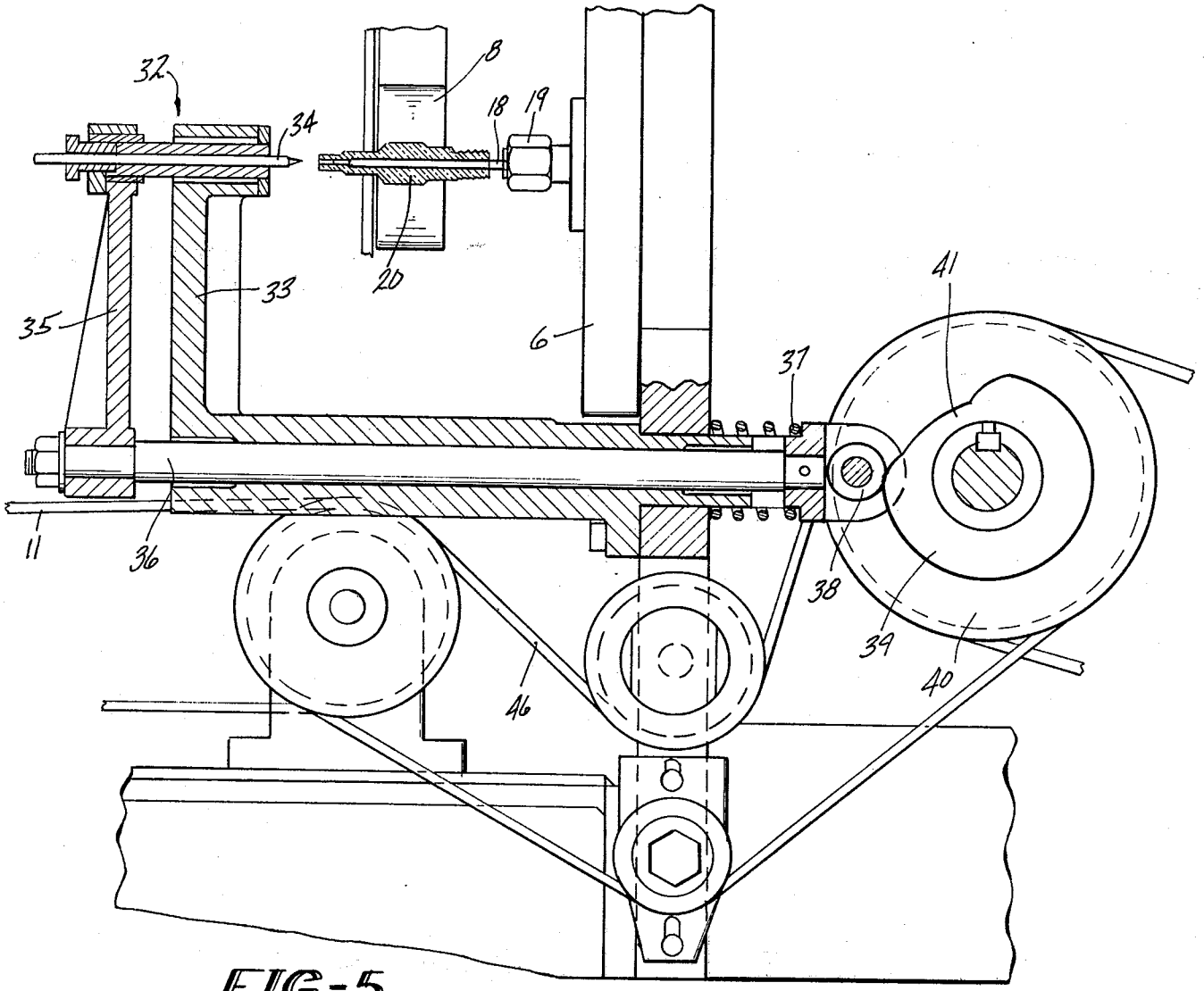
FIG. 5 is a sectional view taken on line 5—5 of FIG. 3.

As best shown in FIGS. 3, 4 and 5, the head 6 is a ten station head indexable through 36° increments in a clockwise direction as viewed in FIG. 3. At each of the 10 stations, a mandrel 18 projects from the head 6 in a direction parallel to an axis 6*a* of rotation of the head 6. The mandrels 18 are held in screw chucks 19 in a manner to permit ready replacement by mandrels of another size.

Moulded spark plug insulator blanks 20 supported in the cups 4 of the conveyor 5 are prevented from falling out of the cups 4, as the cups 4 pass around a direction changing pulley 21 of the conveyor 5, by a cover 22 and pass to a position A located 54° before a top dead center position of the head 6. At this position they are axially aligned with a plunger rod 23 of the loading mechanism 7 and upon rightward movement of the rod 23 as viewed in FIG. 4, are ejected from the cup 4 and engaged on an axially aligned one of the mandrels 18, the mandrel 18 engaging within a blind bore of the blank 20. Axial reciprocation of the rod 23 of the loading mechanism 7 is effected by axially reciprocating a parallel rod 25 by means of a bell crank lever 26 having one of its arms connected the rod 25, the lever 26 being pivoted at a fixed pivot 27 and having a roller 28 on the other of its arms engaged in a cam track 29 of a cam secured on the first constant speed output shaft 30 of the gearbox 16. A further fixed rod 31 is provided to stabilise the loading mechanism 7.

Carried on the respective mandrel 18, the blank 20 is progressed round the head 6 until its arrives at a position B which lies 54° beyond the top dead center position of the head 6.

Figure 8:
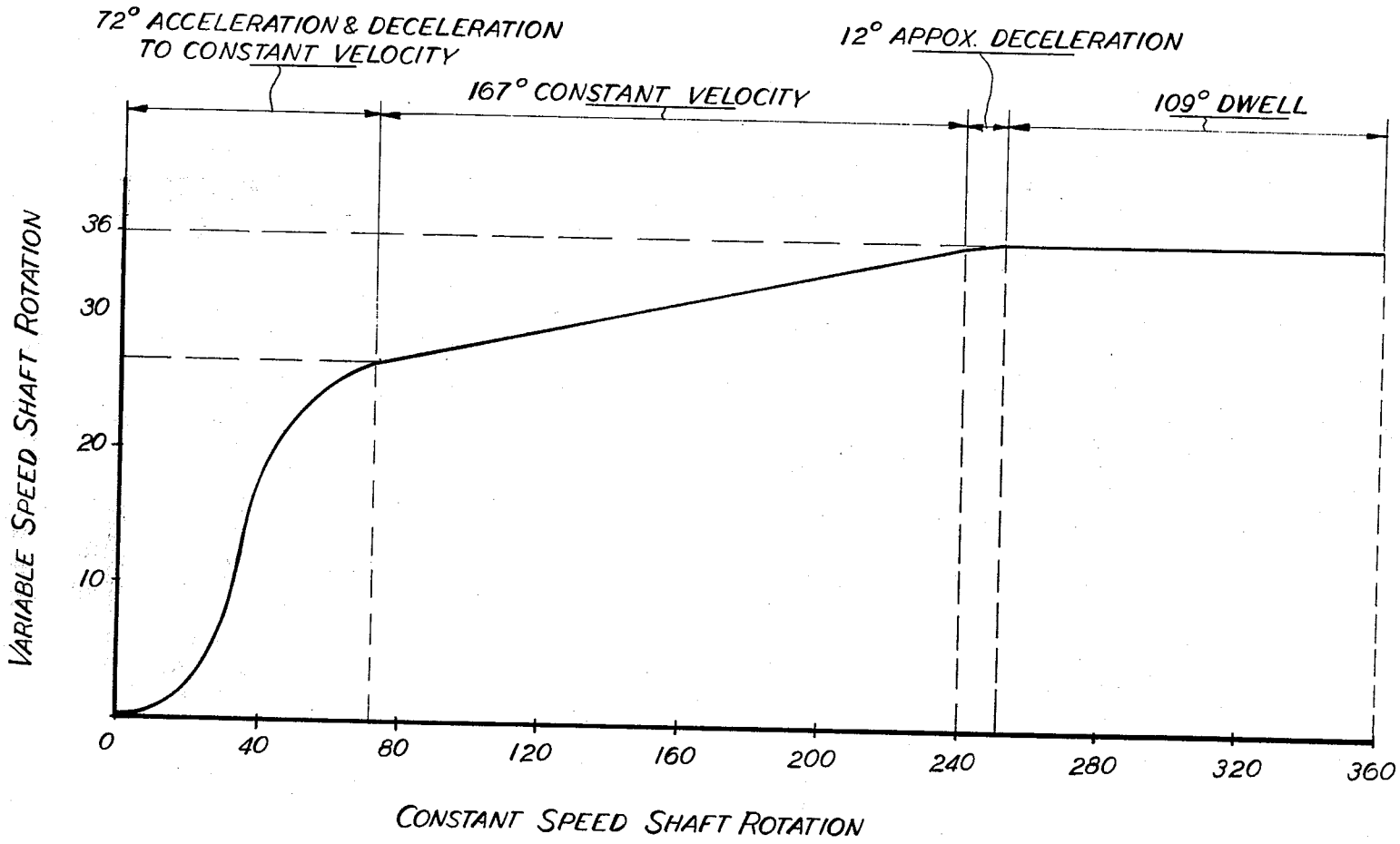
FIG. 8 is an output shaft velocity diagram for the gearbox of the grinding apparatus.

During the time that the constant speed output shaft 30 of the gearbox 16 effects a 360° rotation, the head 6, which is driven from the varying speed output shaft (not shown) of the gearbox 16, is indexed through 36°. FIG. 8 shows the variation in velocity of the head 6 during its 36° movement. Thus, it can be seen that the head initially accelerates away from standstill to a relatively high velocity and is then decelerated until at a position corresponding to about 28° of head rotation and about 72° of rotation of the constant speed output shaft 30, the head 6 is rotating at a relatively low velocity. It is maintained at this relatively low and constant velocity for almost all the remaining 8° of head motion, this period of constant velocity corresponding to rotation of the shaft 30 between approximately 72° and 239°. At a position corresponding approximately to 29° of head movement, the blank 20, which has already engaged the rotating drive wheel 8 and has thereby been spun up to a relatively high speed of rotation, engages the grinding wheel 9 and grinding begins. The constant velocity of the head 6 is stopped when the head reaches its next indexed position, that is to say the position C, grinding continuing in this position for a dwell period corresponding to the 109° of rotation of the shaft 30. Thus, the blank 20 during the 36° indexing movement of the head 6 is moved rapidly to a position closely adjacent the grinding wheel 9, is then slowed to a low velocity and is held stationary in the fully indexed position for a dwell period to ensure that the circumference of the blank is ground to a truly circular and concentric profile.

The ground blank is then accelerated rapidly away from the grinding wheel 9 since this corresponds to the initial part of the cycle of the blank mounted on the next mandrel 18 of the head 6.

During the period that it is held stationary in the fully indexed position and while it is being rotated by the drive wheel 8, the end of the blank remote from the head 6 is acted on by a tip-cutting mechanism generally indicated at 32, in FIG. 5. The tip-cutting mechanism 32 comprises a stationary support 33 having a cutting tool 34 mounted for sliding movement in an upper part thereof, the cutting tool 34 being connected by an arm 35 to a rod 36 slidable in a lower part of the support 33 and biased rightwardly as viewed in FIG. 5 by a spring 37. A cam follower 38 on the rod 36 cooperates with a cam 39 driven by a pulley wheel 40 coupled by a belt drive to the constant speed output shaft 30 of the gearbox 16.

Figure 7:
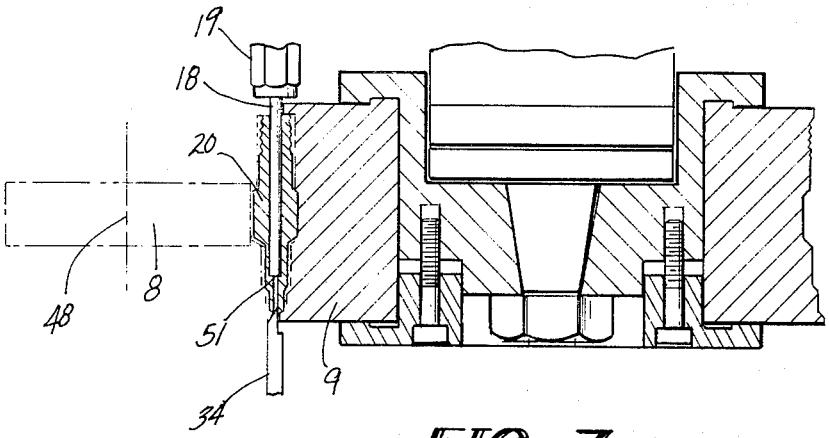
FIG. 7 is a fragmentary and partially sectioned plan view showing relative locations of a drive wheel, workpiece grinding wheel, and tip cutting tool.

When a cut-away portion 41 of the cam 39 contacts the cam follower 38, the tool 34 is allowed to move rightwardly under the force of the spring 37 to engage the tip of the rotating blank 29 remote from the head 6 and to cut away the tip of the blank 20 so that a small chamfer is cut around the free end of the through-bore formed by the grinding wheel 9. The relative positions of the blank 20, driving wheel 8, grinding wheel 9 and cutting tool 34, during the cutting operation effected by the cutting tool 34 are shown in FIG. 7.

The ground and machined blank **20*a* progresses from the position C to a position D which lies 18° beyond a bottom dead center position of the head 6. When in the position D, the blank 20*a* is ejected from the head 6 by the ejecting mechanism 10. As shown in FIG. 4, the ejecting mechanism 10 comprises an ejecting member 42 having a slot 43 (FIG. 3) therein into which the mandrel 18 passes as the head 6 is indexed into the position D. The ejecting member 42 is secured to a rod 44 which is slidable under the action of a bell crank lever 45 pivoted at the same pivot 27 as the bell crank 26. The lever 45 is coupled to the rod 44 with one of its arms and has the other of its arms coupled to the roller 28 engaged in the cam track 29. It will be noted that part of the track 29 is not concentric with the shaft 39 and causes the rod 44 to effect an ejection movement causing the ejecting member 42 to push the ground blank 20*a* off its respective mandrel 18 and onto the discharge conveyor 11 which, as shown in FIG. 5, is driven by a belt 46 coupled to the pulley 40 which is driven by the constant speed output shaft 30**.

Figure 6:
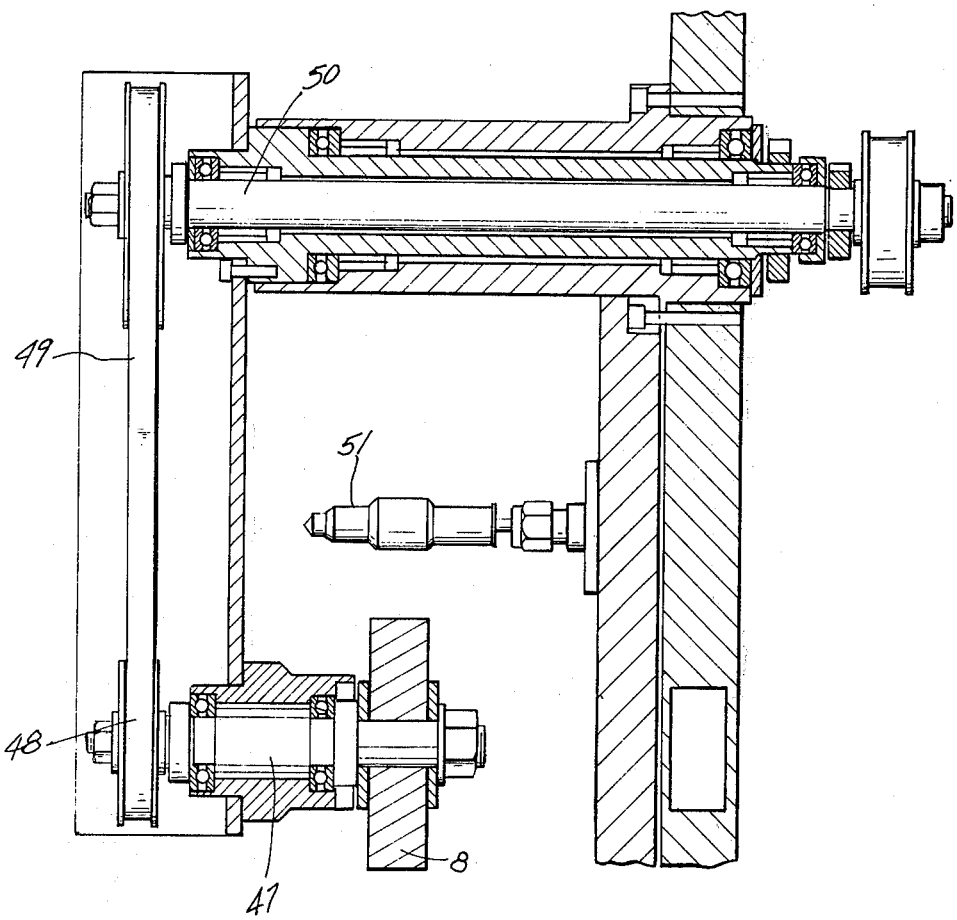
FIG. 6 is a sectional view taken along line 6—6 of FIG. 3 and showing drive means for a drive wheel.

FIG. 6 shows that the control wheel 8 is mounted on a shaft 47 rotatable about an axis 48 by a belt drive 49 from a shaft 50 positioned above the head 6 and belt driven from the motor 12. The axis 48 of the driving wheel 8 is angled to the axis **6*a* of rotation of the head 6 such that the axes 48 and 6*a* are further apart adjacent the head 6 than they are remote from the head 6. This causes the driving wheel 8 to bias the blanks 20 towards the head 6 and ensures that they are in an accurately defined position of the respective mandrel 18. The accurately defined position is defined by a shoulder 51 on the mandrel 18 engaging a step on the bore of the blank 20. The motor 12 is a variable speed motor whereby the control wheel 8** can be set to run at any speed between 15 and 1500 rpm.

It can be seen that since all movements, apart from the continuous rotation of the driving wheel 8 and the grinding wheel 9, are derived from the gearbox 16 driven by the drive motor 17, the grinding apparatus 1 can be stopped and started as desired to take account of any stopping or starting of the moulding apparatus 2, and by simply adjusting the speed of the drive motor 17, the entire operation of the grinding apparatus 1 can be speeded-up or slowed-down as desired or as found necessary to take account of peculiarities of particular workpieces.

The tip-cutting mechanism 32 is only required if a chamfer is required at the end of the bore. If a square end to the workpiece is sufficient this can be provided by a suitably shaped grinding wheel 9.

The gearbox 16 is preferably a gearbox comprising a concave globoidal cam and cooperating roller cam followers on a turret disc of the kind manufactured by Manifold Indexing Limited, Seymour Road, Leyton, London, England.

Since many changes and variations of the disclosed embodiment of the invention may be made without departing from the inventive concept, it is not intended to limit the invention otherwise than as required by the appended claims.

I claim:

1. An apparatus for grinding workpieces, said apparatus comprising:

a. a head rotatable about an axis;

b. a plurality of work-holders mounted on said head for receiving workpieces to be ground, said work-holders being equi-spaced about the axis of said head and movable along an arcuate path when said head is rotated about its axis;

c. grinding means mounted adjacent to said head said grinding means having a moving grinding surface positioned adjacent to said path to engage a workpiece moving along said path; and d. first drive means connected to said head for rotating the latter in step-wise fashion about said axis, said drive means being operative to impart an initial period of relatively rapid rotational movement to said head to rapidly move one of said work-holders and a workpiece mounted thereon from a position remote from said grinding means to a position closely adjacent to said grinding means, and then to impart a subsequent period of relatively slow rotational movement to said head to slowly move the workpiece mounted on said one of said work-holders from said position closely adjacent to said grinding means toward and into engagement with said grinding means grinding surface and then to hold said head against rotational movement when said one of said work-holders is in a grinding position until grinding of the workpiece is completed, and then to impart to said head a period of relatively rapid rotational movement to move said one of said work-holders and the ground workpiece rapidly away from said grinding means.

2. The apparatus of claim 1, wherein said apparatus further comprises loading means for automatically positioning blank workpieces on said work-holders, first conveyor means for moving blank workpieces from a source thereof into position for engagement with said loading means, ejection means for automatically removing ground workpieces from said work-holders, and second conveyor means for moving ground workpieces away from said ejection means.

3. The apparatus of claim 1, further comprising cutting means adjacent said grinding means and automatically actuable to cut an end portion of a workpiece during grinding of the latter to form a chamfer in the workpiece.

4. The apparatus of claim 1, further comprising means for engaging the workpiece during grinding to impart rotational movement to the workpiece on its workholder.

5. The apparatus of claim 2, further comprising second drive means operably connected to and supplying motive power for each of said first and second conveyor means, said loading means, and said ejection means.

6. A method of grinding workpieces comprising the steps of:

a. mounting the workpiece on a work-holder at a first predetermined location;

b. moving said work-holder and workpiece relatively rapidly along a path toward a rotating grinding wheel until said work-holder and workpiece are closely proximate to said grinding wheel;

c. moving said work-holder and workpiece relatively slowly along a predetermined path toward said grinding wheel until said workpiece contacts said grinding wheel as the latter rotates for the grinding operation;

d. retaining said workpiece in contact with said grinding wheel for a time sufficient to complete the grinding operation; and e. moving said work-holder and ground workpiece relatively rapidly away from said grinding wheel along a predetermined path.

7. The method of claim 6, further comprising the step of rotating said workpiece on said work-holder during the grinding operation.

8. A method of grinding workpieces comprising the steps of:

a. providing a rotatable head having a plurality of mandrels mounted thereon which mandrels are equispaced about an axis of rotation of the head;

b. positioning blank workpieces on said mandrels;

c. providing a rotating grinding wheel mounted adjacent said head; and d. automatically rotating said head in rotational steps about said axis, each rotational step moving said mandrels through a predetermined angle along an arc about said axis, and each rotational step including an initial component of relatively rapid velocity, a subsequent component of relatively slow velocity, and a final component of no rotational movement, one of said mandrel-mounted workpieces being disposed in contact with said grinding wheel as the latter rotates for a grinding operation during a part of said subsequent and all of said final components in each rotational step.

* * * * *